US006083030A

United States Patent [19]

Wright

[11] Patent Number: 6,083,030

[45] Date of Patent: Jul. 4, 2000

[54] CONNECTOR LATCH

[75] Inventor: John O. Wright, York, Pa.

[73] Assignee: Osram Sylvania Inc., Danvers, Mass.

[21] Appl. No.: 09/159,018

[22] Filed: Sep. 23, 1998

[51] Int. Cl.[7] ..... H01R 13/62

[52] U.S. Cl. ..... 439/352; 439/581

[58] Field of Search ..... 439/352, 350, 439/353, 354, 357, 358, 581–2

[56] References Cited

U.S. PATENT DOCUMENTS 5,376,014 12/1994 Sumida ..... 439/310

5,718,596 2/1998 Inaba et al. ..... 439/352

*Primary Examiner*—Steven L. Stephan

*Assistant Examiner*—Eugene G. Byrd

*Attorney, Agent, or Firm*—William H. McNeill

[57] ABSTRACT

A connector latch is provided which includes a connector housing which extends through an engagement member. The engagement member is movable from one end of the connector housing to the other end. When moved to one end, the engagement member cams flexible latch arms of the connector housing towards the longitudinal axis thereof in a locked mode. When moved to the opposite end, the flexible latch arms reslide away from such axis in an unlocked mode. An electrical connector which includes such a connector latch is also provided. In such an embodiment, when male and female contacts are properly engaged, movement of the engagement member in the locked mode causes protuberances which extend from the flexible latch arms to extend into a connector housing groove thereby preventing disconnection of the contacts.

20 Claims, 3 Drawing Sheets

CONNECTOR LATCH

TECHNICAL FIELD

The present invention relates to a connector latch and an electrical connector which includes such a latch. More particularly, the present invention relates to a connector latch and electrical connector for use with, for example, an antenna connector.

BACKGROUND ART

Typical electrical connectors such as, for example those used with an antenna connector for an antenna cable such as that used in the automobile industry for radios include a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the male connector, and the other connector, such as the female connector, is electrically and mechanically attached to another coaxial cable or to a circuit such as a circuit on a printed circuit board. In such electrical connectors there is a tendency for the male and female components to become unintentionally disconnected due to opposing axially directed forces which are sometimes inadvertently exerted upon the male connector relative to the female connector. In addition, the lack of satisfactory tactile feedback makes it difficult to know when a suitable connection has been made.

DISCLOSURE OF THE INVENTION

It is an object of the present invention to provide an improved connector latch.

Another object of the present invention is to provide an improved electrical connector including such a connector latch.

It is a further object of the present invention to provide a connector latch and an electrical connector including such a connector latch which prevents inadvertent disconnection thereof.

Another object of the present invention is to provide connector latch and an electrical connector for use as an antenna connector.

This invention achieves these and other results by providing a connector latch which comprises a connector housing extending in a direction of a longitudinal axis from a first end to an opposite second end. The connector housing includes a first portion which extends in such direction from the first end towards the second end and a resilient second portion which extends in such direction from the second end towards the first end. An engagement member is provided which extends in such direction from one end to another end. The connector housing extends through the engagement member. The engagement member is slidable in the direction of the longitudinal axis between the first end of the connector housing and the second end. The second portion is (a) movable towards the longitudinal axis of the connector housing by the engagement member when the engagement member is caused to slide towards the second end of the connector housing in a locked mode, and (b) reslidable away from such axis when the engagement member is caused to slide towards the first end in an unlocked position.

An electrical connector which includes such a connector latch is also provided.

BRIEF DESCRIPTION OF THE DRAWINGS

This invention may be clearly understood by reference to the attached drawings wherein like reference numerals designate like elements and in which.

BEST MODE FOR CARRYING OUT THE INVENTION

Figure 1:
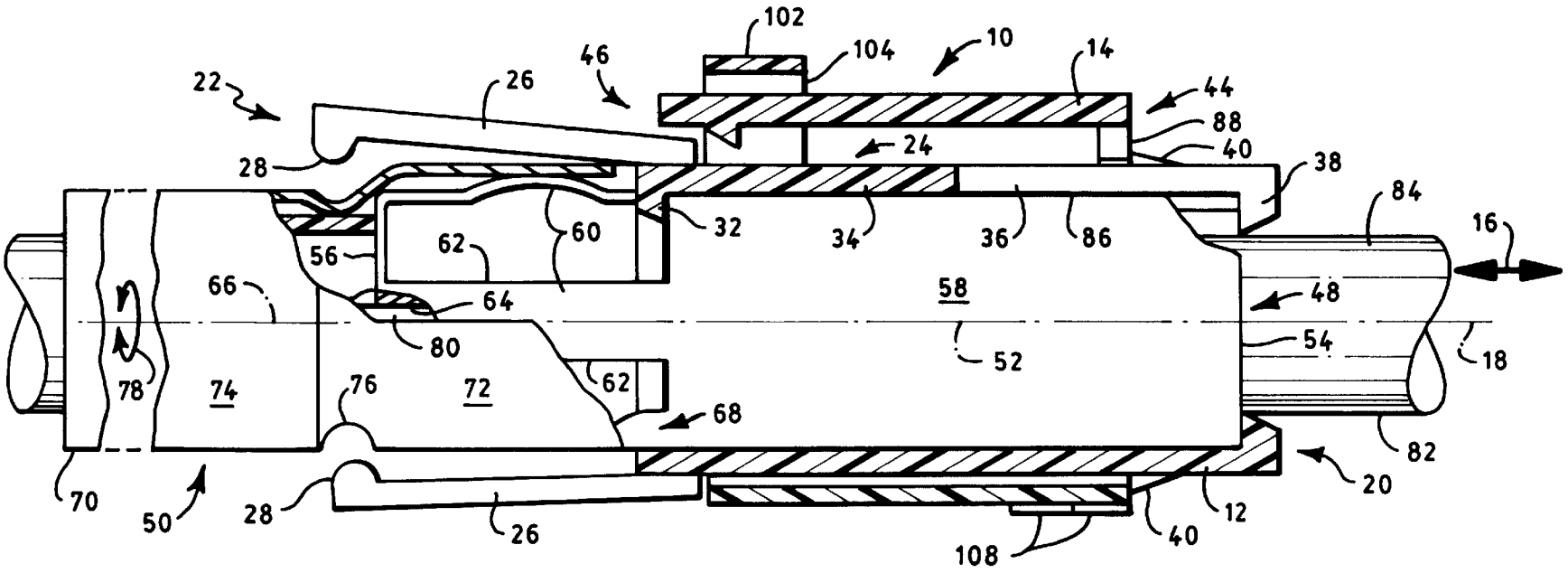
FIG. 1 is a partial sectional view of one embodiment of an electrical connector of the present invention in an unlocked mode.

For a better understanding of the present invention, together with other and further objects, advantages and capabilities thereof, reference is made to the following disclosure and appended claims taken in conjunction with the above-described drawings.

The embodiment of this invention which is illustrated in the drawings is particularly suited for achieving the objects of this invention. In particular, the present invention relates to a connector latch, which includes a connector housing and an engagement member, which is particularly useful in locking together male and female connectors to provide an electrical connector useful, for example, for mechanically and electrically connecting together two lengths of antenna coaxial cable. For example, in the embodiment illustrated in FIGS. 1 and 2, a connector latch 10 is provided which includes a connector housing 12 and an engagement member 14 which extend in a direction 16 of a longitudinal axis 18. The connector latch 10 is illustrated in an unlocked mode (FIG. 1) and a locked mode (FIG. 2) to be described in detail hereinafter.

Figure 3:
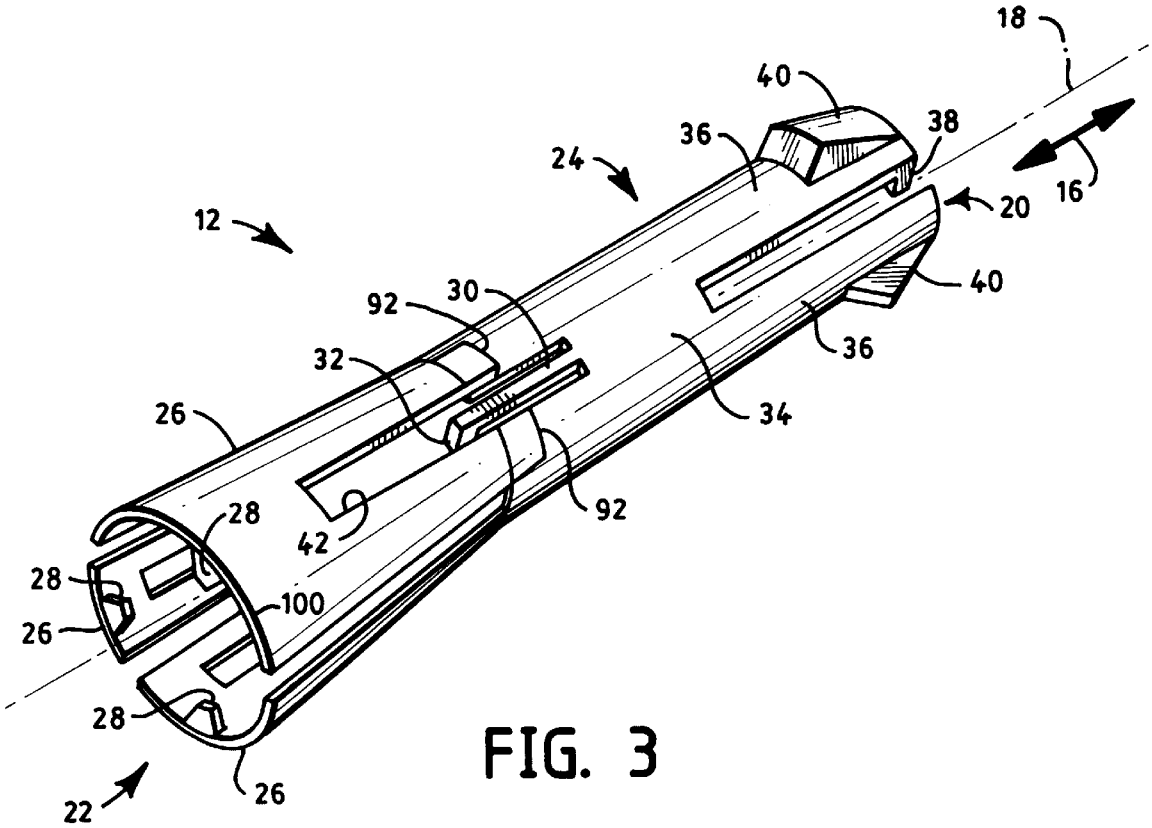
FIG. 3 is a perspective view of one embodiment of a connector housing of the connector latch of the present invention.

FIG. 3 illustrates the structural features of the connector housing 12 which is generally cylindrical in configuration. In particular, connector housing 12 extends in direction 16 of longitudinal axis 18 from a first end 20 to an opposite second end 22. The connector housing of the present invention includes a first portion and a resilient second portion. For example, the connector housing 12 includes a first portion 24 which extends in direction 16 from end 20 towards end 22. The connector housing 12 also includes a resilient second portion in the form of a plurality of resilient first latch arms 26 which extend in direction 16 from the end 22 towards the end 20 to the first portion 24. Without limitation, in the embodiment of FIG. 3 there are three equally spaced latch arms 26. Each latch arm 26 includes a length which comprises a first protuberance 28. Each protuberance 28 extends towards axis 18. Each latch arm length and respective protuberance 28 are moveable towards and away from the axis 18 in a locked and an unlocked mode, respectively, as explained in detail hereinafter.

The connector housing 12 illustrated in FIG. 3 includes a plurality of resilient second latch arms 30 which extend in direction 16 from the first portion 24 towards the second end 22. Without limitation, in the embodiment of FIG. 3 there are three equally spaced latch arms 30. Each second latch arm 30 includes a second protuberance 32 extending towards axis 18. The latch arms 30 are positioned between ends 20 and 22 of the connector housing 12 and extend from a body segment 34.

The first portion 24 of the connector housing 12 illustrated in FIG. 3 includes a plurality of resilient third latch arms 36 which extend in the direction 16 from the body segment 34 towards end 20. Without limitation, in the embodiment of FIG. 3 there are three equally spaced latch arms 36. Each latch arm 36 includes a third protuberance 38 extending towards the axis 18 and a fourth protuberance 40 extending away from axis 18. In the embodiment illustrated in FIG. 3, each first protuberance 28 is adjacent the end 22 of the connector housing 12 and each third protuberance 38 and fourth protuberance 40 is adjacent the end 20. Each second protuberance 32 is adjacent a respective opening 42 which extends for a length of each latch arm 26 from body segment 34 towards end 22, and each latch arm 30 extends from the body segment towards a respective opening 42.

Figure 4:
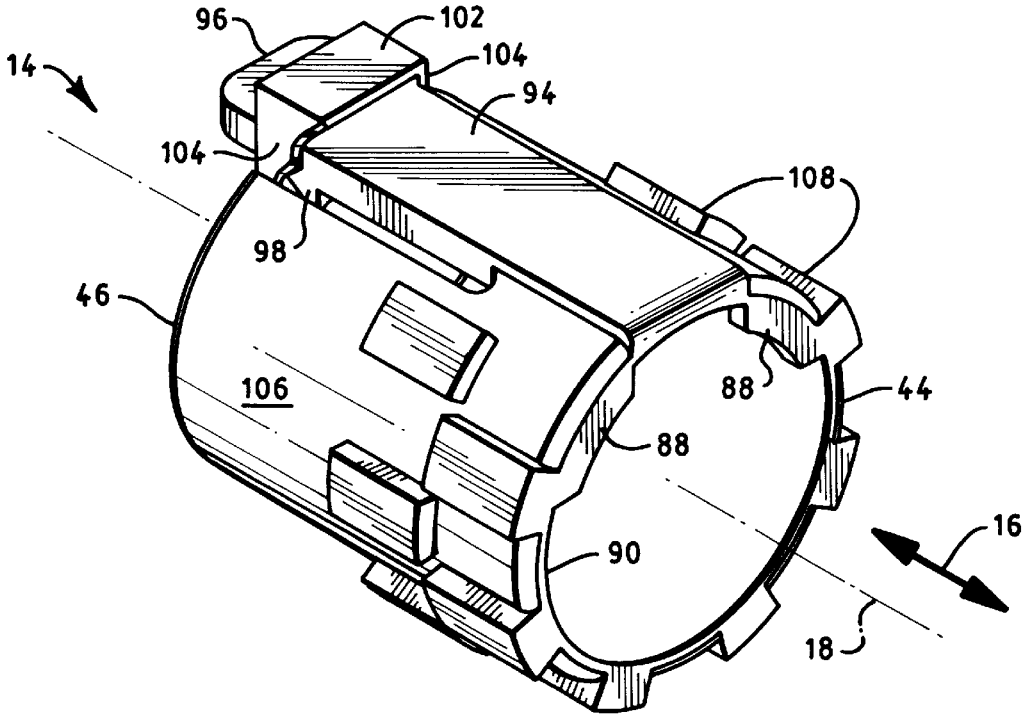
FIG. 4 is a perspective view of one embodiment of an engagement member of the connector latch of the present invention.

One embodiment of the engagement member of the present invention is illustrated in FIG. 4. In particular, the engagement member 14 extends in direction 16 of axis 18 from end 44 to end 46. The engagement member 14 is structured and arranged such that the connector housing of the connector latch of the present invention extends through the engagement member. In the embodiment of the connector latch 10 illustrated in FIGS. 1 and 2, the connector housing 12 extends through the engagement member 14, and the engagement member 14 is slidable in relation to the connector housing 12 in direction 16 between ends 20 and 22 of the connector housing.

The connector latch of the present invention is particularly useful in combination with an electrical connector. For example, the connector latch 10 is particularly useful when assembled with elongated conductive connector bodies 48 and 50 to provide the electrical connector illustrated in FIGS. 1 and 2. The connector body 48 extends in a direction of an axis 52 from an end 54 to an opposite end 56. The connector body 48 includes a first body portion 58 which extends from end 54 towards end 56 and a plurality of elongated legs 60 which extend in the direction of axis 52 from end 56 to the first body portion 58. Adjacent legs 60 are separated by a respective elongated aperture 62 which extends in the direction of axis 52. A first contact 64 is contained within the connector body 48 in a conventional manner.

The connector body 50 extends in the direction of an axis 66 from end 68 to an opposite end 70. The connector body 50 includes a second body portion 72 which extends in the direction of axis 66 from end 68 towards end 70 and a third body portion 74 which extends in the direction of axis 66 from end 70 towards the body portion 72. A groove 76 positioned between the body portions 72 and 74 extends in a circumferential direction 78 about the axis 66. A second contact 80 is contained within the connector body 50.

The connector body 48 and contact 64 are adapted to be connected to the connector body 50 and contact 80, respectively, in an engaged mode. Without limitation, in the embodiment illustrated in FIGS. 1 and 2 the connector body 48 and contact 64 form a conventional female connector, and the connector body 50 and contact 80 form a conventional male connector, used in vehicle applications wherein lengths of antenna cable are to be electrically and mechanically connected together.

The connector latch of the present invention is useful in locking together electrical connector bodies when they are electrically and mechanically connected. For example, in the embodiment illustrated in FIGS. 1 and 2, the connector body 48 extends through the connector housing 12. To this end, the end 82 of a cable 84, to which the connector body 48 and contact 64 are connected in a conventional manner, is inserted through an opening 86 which extends through the connector housing 12. The cable 84 is pulled through the connector housing 12 until each protuberance 32 extending from respective resilient arms 30 snap into a respective elongated aperture 62. As a practical matter, during this operation the first body portion 58 of the connector body 48 will cam the arms 30 away from each other as the first body portion is pulled into the connector housing and engages protuberances 32. When each protuberance 32 is aligned with a respective elongated aperture 62, the protuberance will snap into the aperture. During this operation, the first body portion 58 will also cam the arms 36 away from each other as the first body portion 58 is pulled into the connector housing 12 and engages protuberances 38. The connector housing 12 is structured and arranged such that when each protuberance 32 snaps into a respective aperture 62, The protuberances 38 will snap towards each other and rest adjacent the first body portion 58 at end 54. In this manner any axial movement of the connector housing 12 in direction 16 of axis 18 will be limited by the engagement between the body portion 58 of the connector body 48 and the protuberances 32 and 38, the body portion 58 extending between such protuberances. When the body portion 58 is within the connector housing 12, the axis 52 will be coincident with the axis 18.

When the connector body 48 and connector housing 12 have been assembled as described above, the connector body 50 and contact 80 may be electrically and mechanically connected to the connector body 48 and contact 64 in a conventional manner at which time axis 66 will be coincident with axes 18 and 52, as illustrated in FIG. 1.

In considering the connector latch of the present invention, the engagement member engages and thereby serves to move a resilient portion of the connector housing towards the axis of the connector housing when the engagement member is caused to slide in one direction in a locked mode, and permits the resilient portion to reslide away from the axis of the connector housing when the engagement member is caused to slide in an opposite direction in an unlocked mode. For example, in the embodiment illustrated in FIG. 2 when the engagement member 14 is moved in direction 16 towards end 22 and the distal ends of resilient latch arms 26, the engagement member will engage the resilient latch arms 26 thereby camming the arms and their respective protuberances 28 towards axis 66 and into groove 76. In this locked mode, the engagement of the groove 76 by the protuberances 28 will prevent axial movement between connector bodies 48 and 50 thereby locking together the connector bodies and their respective contacts 64, 80. When the engagement member 14 is moved in the direction 16 towards end 20 and away from the distal ends of the resilient latch arms 26, the engagement member will disengage the latch arms 26 and permit them to reslide away from axis 66 and out of groove 76, as illustrated in FIG. 1. In this unlocked mode, the protuberances 28 no longer will engage the groove 76, and therefore axial movement between connector bodies 48 and 50 will be permitted so that the connector bodies and their respective contacts 64, 80 may be disconnected.

The engagement member of the present invention may include one or more detents extending from an inner surface of the engagement member towards the longitudinal axis thereof. Such detents are useful in controlling the degree to which the engagement member may be caused to slide relative to the connector housing in the locked and unlocked mode. For example, the engagement member 14 illustrated in FIG. 4 includes two detents 88 extending from the inner surface 90 of the engagement member at end 44. Each detent 88 extends towards the axis 18. With reference to FIG. 1, it will be noted that movement of the engagement member 14 towards end 20 of connector housing 12 is limited by the engagement of the detents 88 with the protuberances 40 extending from the connector housing. Similarly, movement of the engagement member 14 towards end 22 may be limited by providing the connecting housing 12 with one or more abutment surfaces which engage the detent 88 when the engagement member has been caused to slide towards end 22 to the extent desired. In the embodiment illustrated in FIG. 3, the proximate ends 92 of the first latch arms 26 provide such abutment surfaces. In particular, with reference to FIG. 2, it will be noted that movement of the engagement member 14 towards end 22 of the connector housing 12 is limited by the engagement of the detents 88 with the abutment surfaces provided at proximate ends 92 of the first latch arms 26.

Figure 2:
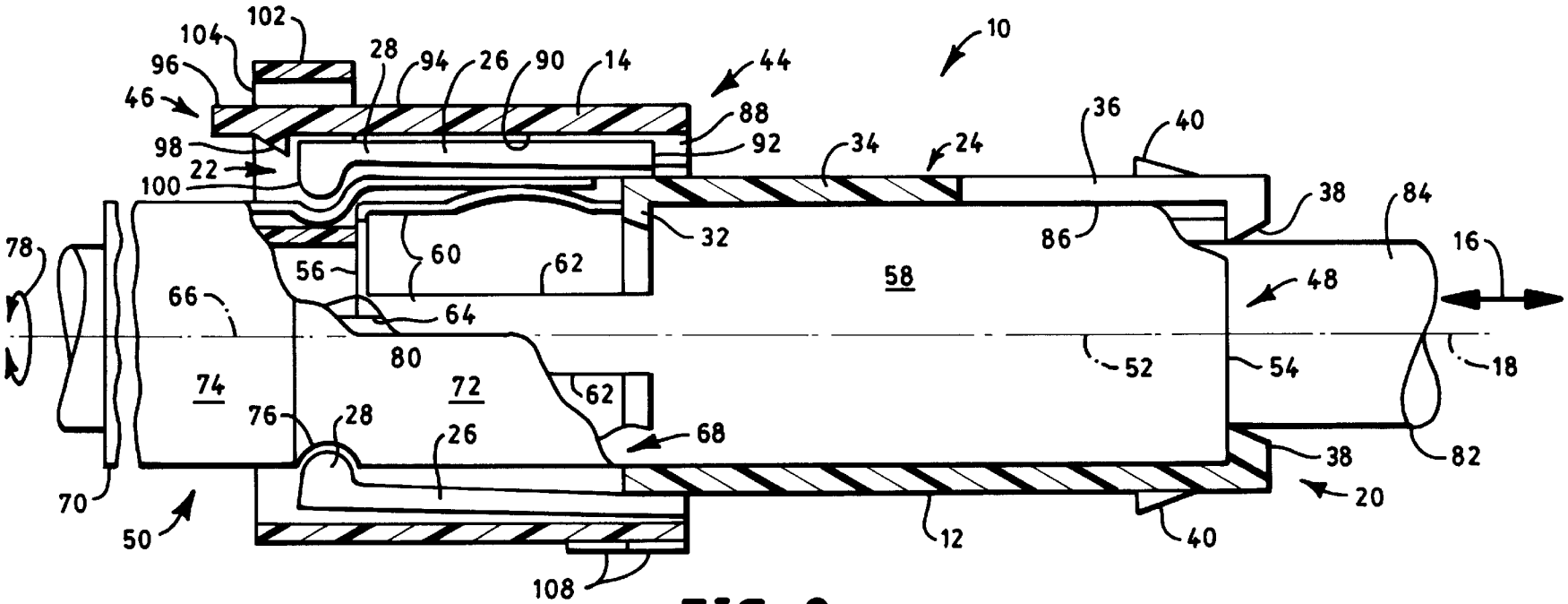
FIG. 2 is a partial sectional view of the electrical connector illustrated in FIG. 1 in a locked mode.

The engagement member of the present invention may include a locking segment which comprises a protrusion extending towards the longitudinal axis of the engagement member. The protrusion is latchable with the distal end of one of the first latch arms in the locked mode and unlatchable therefrom in the unlocked mode. In this manner, the locking segment serves to prevent inadvertent movement of the engagement member when the connector latch is in a locked mode. For example, the engagement member 14 illustrated in FIG. 4 includes a resilient segment 94 which extends in direction 16 of axis 18. The distal end 96 of the segment 94 includes a protrusion 98 which extends toward axis 18. The segment 94 is flexible towards and away from axis 18. The segment 94 is structured and arranged to be cammed away from axis 18 by a first latch arm as the engagement member is caused to slide towards end 22 and the protrusion 98 engages the latch arm. When the protrusion 98 is moved beyond end 22, the protrusion snaps against the distal end 100 of the latch arm 26 to effect a latch therewith to prevent movement of the engagement member 14 towards end 20 in the locked mode as illustrated in FIG. 2. The segment 94 may be unlatched from the latch arm 26 by lifting the segment radially away from axis 18 until the protrusion 98 clears the distal end 100 thereby allowing movement of the engagement member towards end 20 in the unlocked mode. Although not necessary, if desired movement of the segment 94 from a latched to an unlatched condition may be substantially prevented when the connector latch 10 is in the locked mode. In such an embodiment, once the connector bodies 48 and 50 are connected together and the connector latch 10 is in the locked mode as illustrated in FIG. 2, subsequent movement of the connector latch to an unlocked mode will be substantially eliminated without destroying the connector latch. To this end, the engagement member 14 may include an abutment surface 102 which is disposed above the segment 94 by walls 104 which extend from an outer surface 106 of the engagement member. The abutment surface 102 is structured and arranged such that when the engagement member 14 is in the locked mode, radial movement of the segment 94 away from axis 18 will be limited. In particular, such radial movement will be limited to the extent that the segment 94 will engage the abutment surface 102 before the protrusion 98 is able to be moved above the distal end 100 of the latch arm 26, the protrusion thereby continuing to prevent movement of the engagement member towards end 20. Ribs 108 may be provided to facilitate axial movement of the engagement member 14.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A connector latch for securing one of a male or female connector end of a coaxial cable to a compatible socket, comprising:

a connector housing extending in a direction of a longitudinal axis from a first end to an opposite second end and including a first portion which extends in said direction from said first end towards said second end and a resilient second portion which extends in said direction from said second end towards said first end said connector housing being symmetrically arrayed about said longitudinal axis; and an engagement member extending in said direction from one end to another end, said connector housing extending through said engagement member, said engagement member being slidable in said direction between said first end and said second end, said second portion being (a) moveable towards said axis by said engagement member when said engagement member is caused to slide towards said second end in a locked mode and (b) reslidable away from said axis when said engagement member is caused to slide towards said first end in an unlocked mode.

2. The connector latch of claim 1 wherein said second portion comprises a plurality of resilient first latch arms which extend in said direction from said second end to said first portion, each first latch arm of said plurality of resilient first latch arms including a length which comprises a first protuberance extending towards said axis, said length and said first protuberance being movable towards and away from said axis in said locked and unlocked mode, respectively.

3. The connector latch of claim 2 wherein said connector housing further comprises a plurality of resilient second latch arms which extend in said direction from said first portion towards said second end, each second latch arm of said plurality of resilient second latch arms including a second protuberance extending towards said axis, said plurality of resilient second latch arms being positioned between said first end and said second end.

4. The connector latch of claim 3 wherein said first portion includes a body segment between said plurality of resilient first latch arms and said first end, and further wherein said first portion comprises a plurality of resilient third latch arms which extend in said direction from said body segment towards said first end, each third latch arm of said plurality of resilient third latch arms including a third protuberance extending towards said axis.

5. The connector latch of claim 4 wherein each third latch arm further comprises a fourth protuberance extending away from said axis, said engagement member comprises a first detent extending towards said axis and structured and arranged to engage said fourth protuberance in said unlocked mode, and said connector housing comprises a second detent structured and arranged to engage said first detent in said locked mode.

6. The connector latch of claim 5 wherein each first latch arm comprises an opening extending from said body segment towards said second end, and further wherein each second latch arm extends from said body segment towards a respective opening.

7. The connector latch of claim 6 wherein each first protuberance is adjacent said second end, each second protuberance is adjacent to a respective opening, and each third and fourth protuberance is adjacent said first end.

8. The connector latch of claim 2 wherein said engagement member comprises a locking segment, said locking segment comprising a protrusion extending towards said axis, said protrusion being latchable with a first latch arm at said second end in said locked mode, and unlatchable from said first latch arm in said unlocked mode.

9. The connector latch of claim 8 wherein said locking segment comprises a resilient segment which extends in said direction, said resilient segment being flexible towards and away from said axis.

10. The electrical connector of claim 9 wherein said engagement member comprises an abutment surface adjacent said resilient segment, said abutment surface being structured and arranged to retard flexing of said resilient segment away from said axis thereby substantially preventing unlatching of said protrusion from said first latch arm in said locked mode.

11. An electrical connector for joining at least one end of a coaxial cable to a socket, comprising:

an elongated conductive first connector body extending in a first direction of a first longitudinal axis from a first end to an opposite second end and comprising a first body portion extending in said first direction from said first end towards said second end and a plurality of elongated legs extending in said first direction from said second end to said first body portion, adjacent legs of said plurality of elongated legs being separated by a respective elongated aperture which extends in said first direction;

a first contact contained within said first connector body;

an elongated conductive second connector body adapted to be connected to said first connector body in an engaged mode, said second connector body extending in a second direction of a second axis from one end to an opposite end and comprising a second body portion extending in said second direction from said one end towards said another end and a third body portion extending in said second direction from said another end towards said second body portion, a groove positioned between said second and third body portions and extending in a third direction circumferentially about said second axis;

a second contact contained within said second connector body and adapted to be connected to said first contact in said engaged mode;

a housing extending in said first direction, said first connector body extending through said housing, said housing comprising a plurality of resilient first latch arms which extend in said first direction, each first latch arm comprising a first protuberance extending towards said first axis, said housing being symmetrically arrayed about said longitudinal axis;

an engagement member symmetrically arrayed about said housing, extending in said first direction, said housing extending through said engagement member, said engagement member being slidable in said first direction relative to said housing; each first protuberance being (a) movable by said engagement member, in a locked mode, towards said second axis and into said groove when said first connector body and said first contact are connected to said second connector body and said second contact, respectively, and said engagement member is caused to slide towards distal ends of respective first latch arms, and (b) reslidable away from said second axis and out of said groove, in an unlocked mode, when said engagement member is caused to slide towards said first end.

12. The electrical connector of claim 11 wherein said housing further comprises a plurality of resilient second latch arms which extend in said first direction, each second latch arm comprising a second protuberance extending towards said first axis, each second protuberance being structured and arranged to snap into a respective elongated aperture when each second protuberance is aligned with a respective elongated aperture.

13. The electrical connector of claim 12 wherein said housing comprises a plurality of resilient third latch arms which extend in said first direction, each third latch arm comprising a third protuberance extending towards said first axis, each third protuberance being adjacent said first body portion at said first end when each second protuberance extends into a respective elongated aperture.

14. The electrical connector of claim 13 wherein each third latch arm further comprises a fourth protuberance extending away from said first axis, said engagement member being slidable into engagement with said fourth protuberance in said unlocked mode.

15. The electrical connector of claim 14 wherein each first latch arm comprises an elongated opening extending in said first direction, and further wherein each second latch arm extends towards a respective elongated opening.

16. The electrical connector of claim 15 wherein said engagement member comprises a locking segment, said locking segment comprising a protrusion extending towards said first axis, said protrusion being latchable with a first latch arm in said locked mode and unlatchable from said first latch arm in said unlocked mode.

17. The electrical connector of claim 16 wherein said locking segment comprises a resilient segment which extends in said first direction, said resilient segment being flexible towards and away from said first axis.

18. The electrical connector of claim 17 wherein said engagement member comprises an abutment surface adjacent said resilient segment, said abutment surface being structured and arranged to retard flexing of said resilient segment away from said first axis thereby substantially preventing unlatching of said protrusion from said first latch arm in said locked mode.

19. The electrical connector of claim 14 wherein said engagement member comprises at least one first detent which extends towards said first axis and is structured and arranged to engage a fourth protuberance in said unlocked mode, and further wherein said housing comprises at least one second detent structured and arranged to engage a first detent in said locked mode.

20. The electrical connector of claim 19 wherein each second detent comprises a proximate end of a first latch arm.

* * * * *